United States Patent [19]

Hunt

[11] Patent Number: 4,628,543

[45] Date of Patent: Dec. 16, 1986

[54] COMBINATION CAP AND BASEBALL GLOVE

[76] Inventor: William J. Hunt, 2410 Kingsley Dr., Macon, Ga. 31204

[21] Appl. No.: 791,288

[22] Filed: Oct. 25, 1985

[51] Int. Cl.[4] ..... A41D 13/10; A41D 19/00

[52] U.S. Cl. ..... 2/19; 2/161 A; 2/195; 2/196

[58] Field of Search ..... 2/19, 195, 197, 199, 2/161 A, 196

[56] References Cited

U.S. PATENT DOCUMENTS

| | | | |
|---|---|---|---|
| 789,480 | 5/1905 | Bennett | 2/19 |
| 1,057,204 | 3/1913 | Yudelson | 2/66 X |
| 1,974,616 | 9/1934 | Kirkham | 2/19 |
| 2,007,235 | 7/1935 | Woodside | 2/196 X |
| 2,333,987 | 11/1943 | Dandy | 2/195 X |

*Primary Examiner*—Louis K. Rimrodt

*Attorney, Agent, or Firm*—Dowell & Dowell

[57] ABSTRACT

A cap, hat or similar headwear having an inner lining defining a pocket which has an opening along a portion thereof so as to permit a person to insert their hand within the pocket so that the headwear may be used as a glove.

19 Claims, 9 Drawing Figures

Fig. 4
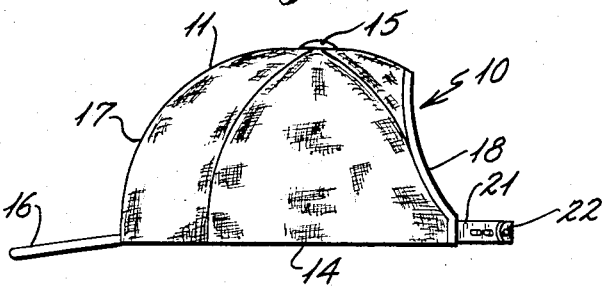
Fig. 5
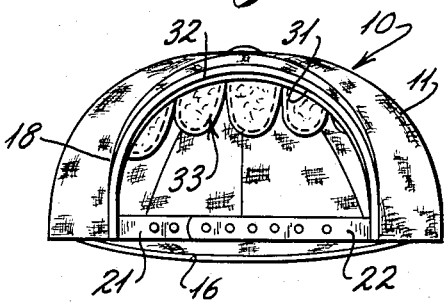
Fig. 6
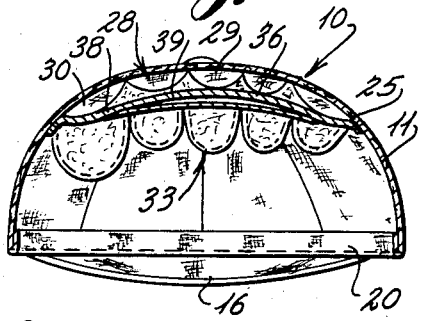
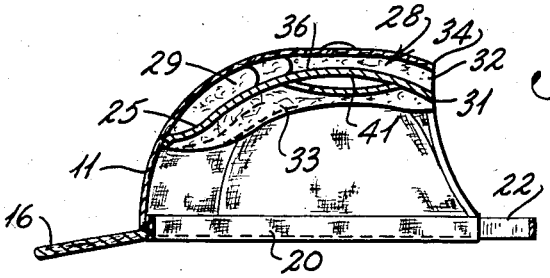
Fig. 7
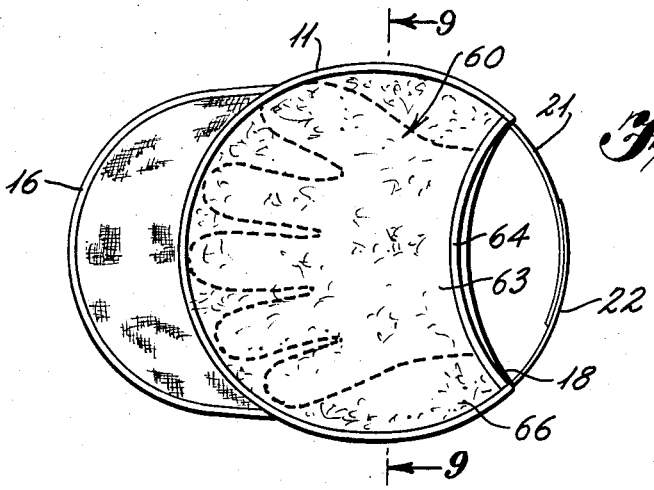
Fig. 8

COMBINATION CAP AND BASEBALL GLOVE

BACKGROUND OF THE INVENTION

1. Field of the Invention

This invention is generally directed to caps and hats and particularly to caps, hats and similar headwear particularly of the style or type worn by spectators at sporting events which are structured to include an inner pocket which may include a resilient lining so that the cap can be used by a spectator as a glove for catching balls hit into the stands, seats, bleachers or other area where spectators may be located. In this respect the invention relates to hats or caps which are designed to offer protection from the sun which also can be used to provide handwear in the form of a glove such as a baseball glove to protect the hands when a person attempts to catch balls hit into their vacinity.

2. History of the Invention

Anyone who has ever attended a professional, semi-professional, minor league or even youth baseball game is aware that frequently, balls are hit into spectator seating areas. In professional sports, the desire to carry home a professionally hit ball as a souvenir often drives spectators to overly zealous and sometimes dangerous extremes in efforts to catch or retrieve balls hit into their general area. Although spectators at such sporting events assume their own liability for injury due to balls which are hit into the stands or seating area, injuries do occur from people trying to catch or avoid a ball with their bare hands.

In anticipation of encountering a ball hit into the stands or other seating or spectator area, many people who attend baseball games carry a baseball glove which they can use as necessary. Unfortunately, the baseball glove is just another personal belonging which must be carried to and from the game and an item which is subject to theft or accidental misplacement if left unattended.

Another souvenir item which is very popular among spectators of all ages are baseball caps or hats which carry a favorite team logo or other indentification. Such hats or caps are not only novelty type items but are also items which can be used to protect the wearer from the sun or rain. Frequently, professional teams will utilize team caps as give away items in order to encourage increased attendance and fan involvement at various games.

SUMMARY OF THE INVENTION

This invention is generally directed to articles of clothing and particular novelty items such as baseball caps which are worn by spectators at sporting events including baseball games and particularly to the combination of a baseball hat and glove wherein the hat or cap is formed having an inner lining defining a pocket which has an opening along a portion of the edge of the cap so as to permit a person to insert their hand within the pocket so that the cap or headwear may be used as a glove. In one embodiment of the invention, a resilient padding or protective material may be provided between the pocket and the inner surface of the cap in order to protect a person's hand when the cap is being used as a glove. Although the pocket may be formed having defined finger enclosing cavities therein, the pocket may also be formed with only a single cavity or with one cavity defining an area for the fingers and another separate opening defining an opening for a person's thumb. The inner lining may also be formed to accomodate either the left or the right hand of a person so that the glove may be utilized by persons who are either righthanded or lefthanded.

It is a primary object of this invention to provide a protective article of clothing which may be utilized either as a cap or hat to protect the wearer from the sun, rain, wind and other environmental elements or as a baseball glove which may be selectively worn to protect the hand of a person when attempting to catch a baseball.

It is a further object of the present invention to provide a combination cap and baseball glove which has particular utility as a novelty item to encourage the interest of spectators at professional sporting events and which may be utilized either as a cap to be worn on a person's head or as a baseball glove which may be utilized to catch balls hit into the spectator area.

It is another object of the present invention to provide a combination baseball cap and glove which may be formed of a lightweight material and yet provides sufficient padding along the upper portion of the cap to protect the wearer's hand when the cap is being utilized as a hand covering or baseball glove. In this particular regard, the cap may have either a fixed or removable padding which will effectively extend along the area of a person's palm and/or fingers when a person's hand is inserted within the linings forming the glove portion of the combination baseball cap and glove.

It is yet another purpose of the present invention to provide a combination baseball cap and glove wherein the cap may be made of a lightweight material so as to be comfortably worn on a person's head and which includes an opening into the upper portion of the cap through which a person may insert their hand while the cap is being worn so as to position their hand within a pocket area defined therein and thereafter the cap lifted from engagement with the person's head into a position for enabling the cap to be utilized as a baseball glove.

It is also an object of the present invention to provide a combination baseball cap and glove which may be formed of a lightweight and inexpensive material and which may carry various indicia representative of different teams or other identities and which may be utilized as a novelty item or as a protective article of clothing to protect the head and hand of the user.

BRIEF DESCRIPTION OF THE DRAWINGS

FIG. 4 is a side view of the cap of FIG. 1 as taken from the left side thereof.

FIG. 5 is a rear elevational view of the cap of FIG. 1.

FIG. 6 is a cross sectional view taken along lines 6—6 of FIG. 2.

FIG. 7 is a cross sectional view taken along lines 7—7 of FIG. 2.

FIG. 8 is a bottom plan view of another embodiment of the invention showing the outline of the glove portion by a dotted line.

DESCRIPTION OF THE PREFERRED EMBODIMENT

Figure 1:
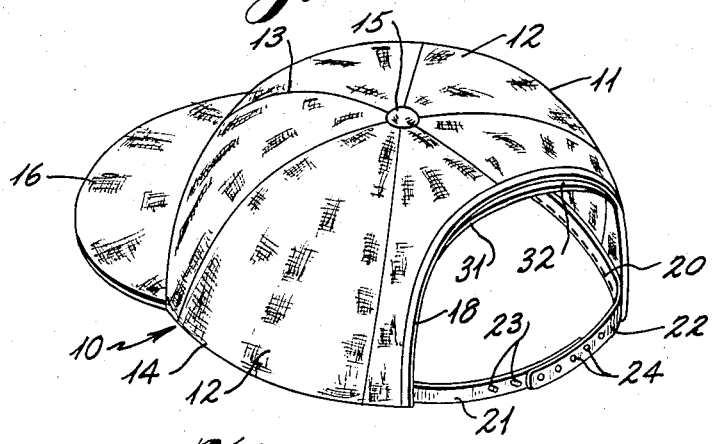
FIG. 1 is a perspective view of the combination cap and baseball glove of the present invention.

With continued reference to the drawings, combination cap and baseball glove 10 is shown in FIG. 1 as simulating the style of a traditional baseball cap having a main body portion 11 which is defined by a plurality of separate fabric panels which are joined along seams 13. Each of the fabric panels 12 extends from the bottom or rim portion of the hat 14 upwardly to the crown of the cap 15. A brim 16 is shown as being mounted to and extending outwardly from the front 17 of the cap. The rear portion of the cap is generally defined by an inverted U-shaped edge 18 which defines an open area 19. The cap may further include an inner head band or sweatband 20 and adjusting straps 21 and 22 which extend outwardly from the head band along the rear portion of the cap so as to be selectively engageable with respect to one another through the use of locking pins 23 which are carried by the strap 21 and which are engageable through openings 24 through the adjusting strap 22.

The structure of the cap is such as to create the appearance of a conventional baseball cap as utilized throughout the United States. It should be noted, that other cap or hat structures may be used in the combination baseball hat and glove of the present invention and that the cap structure shown in the drawings is merely an example of one type of cap structure which may be used in the combination of the present invention.

The baseball cap generally is manufactured using a canvas or nylon like materials which are generally self-supporting but flexible so the glove may be folded or carried in the person's pocket or which may be unfolded and assume the shape of cap shown in the drawings.

Figure 2:
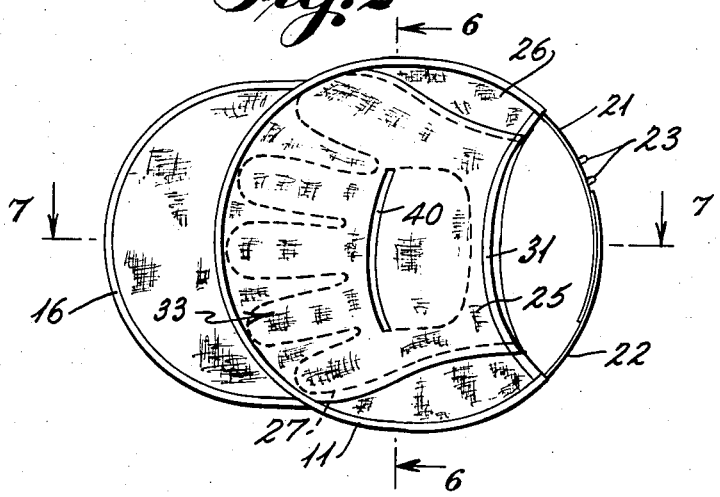
FIG. 2 is a bottom plan view of the cap shown in FIG. 1 showing one form of baseball glove as incorporated therewith.

Unlike conventional baseball caps, the combination cap and glove 10 includes an inner liner or fabric layer 25 which extends in facing relationship with the inner surface 26 of the body portion 11 of the cap. With particular reference to FIG. 2 of the drawings, the inner liner 25 is shown as being in the shape of a hand, particularly a right hand, which is attached in generally spaced relationship with respect to the body portion of the cap by stitching 27. As the stitching 27 outlines the shape of a hand, a pocket 28 is formed between the liner 25 and the inner surface 26 of the cap. The pocket 28 includes finger cavities 29, thumb cavity 30 and a broad central cavity 30 which is adapted to receive the main portion of a person's hand. The rear edge 31 of the inner liner 25 is not attached to the edge portion 18 of the cap so that an opening 32 is created into the glove 33 defined by the inner surface 26 of the cap and liner 25. In order to strengthen the opening 32, the rear edge 31 of the liner 25 and the edge portion 18 of the cap are reinforced with covering seam material 34.

The inner liner 25 is preferrably constructed of a padded or resilient material such as foam rubber or a soft leather-like material which will provide a cushioned surface along the inside of the cap. The cushion surface will protect the wearer's hand when the cap is utilized as a glove to catch baseballs. It should be noted, however, that other materials including natural and synthetic materials may also be used to form the liner 25. In the event further padding or protection is desired to protect a person's hand from injury when using the combination cap and glove 10 as a ball glove, a secondary material liner 36 may be secured to the inner surface 37 of the liner 35 by stitching 38. The secondary liner is spaced from the primary liner so as to form a secondary padding pocket 39 therebetween. An opening 40 is shown as being made through the outer or primary liner and into the secondary pocket so as to permit the selective placement of padding therein. Such padding may include foam, sponge or other resilient pads 41 such as shown in FIG. 7. The pads 41 may be of varying sizes and densities depending upon the particular size of cap. As opposed to making the opening 40 through the outer liner 25, the opening could be made between the liners 25 and 36.

Figure 3:
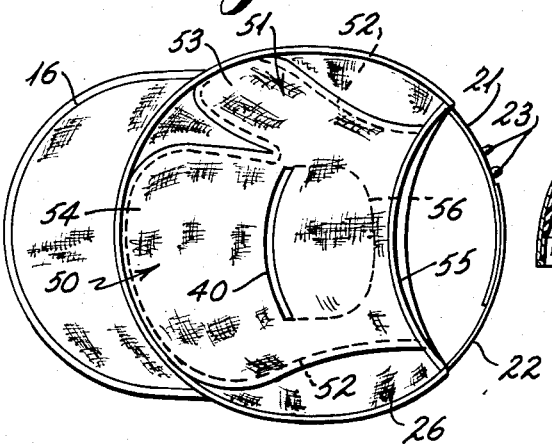
FIG. 3 is a bottom plan view of the cap shown in FIG. 1 showing a second embodiment of the baseball glove or pocket formation as incorporated therewith.

A modified embodiment of the invention is shown in FIG. 3. In this embodiment, the cap construction remains generally the same as discussed with respect to the prior embodiment, however the glove portion 50 of the cap has been modified and resembles a "mitt" structure as opposed to the fingered glove configuration shown in FIGS. 2, 6 and 7. The inner or primary liner material 51 is shown as being secured along its edges by stitching 52 to the inner surface 26 of the cap. A pocket is thereby created between the liner 51 and the inner surface 26 of the cap which pocket includes an area or portion 53 in which a person's fingers may be received and a thumb receiving portion 54. Access to the pocket is provided through a rear opening 55 formed between the liner 51 and inner surface 26 of the cap. As with the prior embodiment, a separate padding pocket 56 may be formed along the inner surface of the liner 51 in which padding material may be selectively placed.

Figure 9:
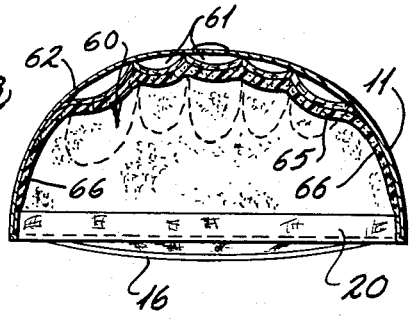
FIG. 9 is a cross sectional view taken along lines 9—9 of FIG. 8 showing a padded layer portion of the glove.

Another embodiment of the invention is shown in FIGS. 8 and 9. In this embodiment, the configuration of the glove 60 is generally the same as the glove 33 of the preferred embodiment and includes finger cavities 61, thumb cavity 62 and central cavity 63. Access to the cavities is formed through an opening 64 created between the inner liner 65 and the inner surface 26 of the cap. In order to provide added protection for a person's hand, a supplemental inner lining material 66 is provided in overlying relationship with respect to the inner liner 65. The supplemental lining may be a leather or leather-like material similar to the type of material used in conventional baseball gloves. With this embodiment, the additional padding pocket shown in the prior embodiment may not be necessary as the supplemental lining should provide sufficient additional padding to protect a person's hand.

Although not specifically shown in the drawings, it could be possible to form the glove portion of the present invention along the outer surface of the cap so that the finger and thumb cavities or portions thereof would be visible along the outside of the cap. The disadvantage of such a structure, however, is that the cap would not resemble a traditional or conventional cap as do the caps shown with respect to the preferred embodiments. Also, it is envisioned that team logos and other indicia will be provided along the outer surface and brim of the cap in order to make the cap and glove combination more appealing to the fans or spectators at a baseball game.

In use of the combination baseball cap and glove of the present invention, a person may wear the cap on their head just as they would any other conventional cap. However, in the event a ball is hit in their direction, a person need only insert their hand through the opening formed in the back of the cap and into the pocket formed therein and thereby have a glove covering their hand which glove can be used to catch balls in a manner similar to the use of a conventional baseball glove. In the event additional padding is necessary either to provide increased protection for the hand or to adjust the size of the glove to fit small hands, such padding may be easily inserted into the padding pockets created within the glove. As was previously discussed, the combination cap and glove may be formed of various materials including a sponge or foam rubber. If the entire structure is formed of a foam or sponge rubber material, the stitching referred to in the discussion of the preferred embodiment would be replaced with heat sealed or glued seams. Also, although the openings into the glove cavities have all been disclosed as being at the rear of the cap, the orientation of the linings which form the glove may be varied so that the openings therein may be located along any portion of the main body of the cap.

We claim:

1. A protective article of wearing apparel for selective use as a cap for covering a person's head or a baseball glove for wearing on a person's hand comprising crown portion to lower edge portions and which is defined by inner and outer surfaces, said cap being of a size to fit over the person's head, a material liner having edge portions which are attached to said main body of said cap to permit access into said pocket, said pocket being of a size to accommodate the person's hand therein, said liner and said cap thereby forming a baseball glove which may be selectively worn on a person's hand.

2. The protective article of wearing apparel of claim 1 in which said material liner is attached to said inner surface of said main body of said cap.

3. The protective article of wearing apparel of claim 2 including a supplemental pocket means attached to said material liner, and padding means carried within said supplemental pocket means.

4. The protective article of wearing apparel of claim 3 in which said supplemental pocket means is positioned between said material liner and said inner surface of said cap, and an opening to permit access into said supplemental pocket means.

5. The protective article of wearing apparel of claim 4 in which said opening to permit access into said supplemental pocket means is through said material liner.

6. The protective article of wearing apparel of claim 2 in which said material liner is attached to said main body so as to create at least two cavities therein for receiving the fingers and thumb of a person's hand.

7. The protective article of wearing apparel of claim 6 which said main body of said cap includes front and rear portions, said rear portion being generally open and defined by arcuate edge portions, said opening into said pocket of said blove being adjacent said edge portions of said rear portion of said cap.

8. The protective article of wearing apparel of claim 6 including a secondary lining material attached in overlaying relationship with respect to said material liner, said secondary lining material providing additional padding for said glove.

9. The protective article of wearing apparel of claim 1 in which said material line is a cushioned material which is attached to said main body of said cap so as to create a plurality of cavities therein for receiving the fingers and thumb of a person's hand.

10. The protective article of wearing apparel of claim 1 in which said material liner is a cushioned material which is attached to said inner surface of said cap so as to create a first cavity in which a person's fingers may be recieved and a second cavity in which a person's thumb may be received.

11. In a cap having a head covering body member which extends from an upper crown to a lower edge portions and includes inner and outer surfaces and front and rear portions, a brim attach to said front portion, the improvement comprising a baseball glove means secured to the head covering body member so as to be in generally opposing relationship to the upper crown portion thereof, said base ball glove means including a liner material attached to said body member so as to create a pocket therebetween in the area of the crown portion thereof, shaped to accommodate a person's hand therein, and an opening between said liner material and said head covering body member into said pocket.

12. The cap of claim 11 including an open area in the rear portion of saidhead covering body member, said open area defined by arcuate edge portions, said opening into said pocket of said baseball glove means being adjacent said edge portions defining said open area of the cap.

13. The cap of claim 12 in which said liner material is attached to said inner surface of the cap so as to create a plurality of outwardly extending and adjoining cavities therein for receiving the fingers and thumb of a person's hand.

14. The cap of claim 12 in which said liner material is attached to said inner surface of said cap so as to create a first cavity in which a person's fingers may be received and a second adjoining cavity in which a person's thumb may be received.

15. The cap of claim 11 in which said liner material is attached to said inner surface of the cap, a supplemental pocket means attached to said liner material, and padding means carried within said supplemental pocket means.

16. The cap of claim 15 in which said supplemental pocket means is positioned between said liner material and said inner surface of said cap, and an opening to permit access into said supplemental pocket means.

17. A protective article of wearing apparel for selective use as a cap for covering a person's head or as a baseball glove for wearing on a person's hand comprising a cap having a mainbody which extends from an upper crown to lower edge portions and which is defined by inner and outer surfaces and front and rear portions, said cap being of a size to fit over the person's head, an inner material liner attached to said inner surface of said cap so as to create atleast two adjoining cavities therebetween for receiving portions of a person's head, said rear portion of the cap being generally open and defined by arcuate edge portions, an opening between said inner liner and said inner surface of said cap adjacent said edge portions defining said open rear portion of said cap to permit access into said cavities, and said cavities forming a pocket of a size to accommodate a person's hand therein.

18. The protective article of wearing apparel of claim 17 including padding means carried within said pocket.

19. The protective article of wearing apparel of claim 17 in which said main body of said cap and said inner material liner are formed of a soft rubber material.

* * * * *